United States Patent [19]

Deltatto

[11] Patent Number: 4,883,145

[45] Date of Patent: Nov. 28, 1989

[54] ERGONOMIC AERIAL BASKET

[76] Inventor: Charles D. Deltatto, 184 Northampton St., Easthampton, Mass. 01027

[21] Appl. No.: 280,831

[22] Filed: Jan. 25, 1989

Related U.S. Application Data

[63] Continuation-in-part of Ser. No. 155,537, Feb. 12, 1988, abandoned.

[51] Int. Cl.[4] ..... B66F 11/04

[52] U.S. Cl. ..... 182/2; 182/90; 182/228

[58] Field of Search ..... 182/2, 90, 46, 228

[56] References Cited

U.S. PATENT DOCUMENTS

| | | | |
|---|---|---|---|
| 2,954,092 | 9/1960 | Thorton-Trump . | |
| 3,087,581 | 4/1963 | Pitman . | |
| 3,396,814 | 8/1968 | Garnett . | |
| 3,404,751 | 10/1968 | Nosworthy . | |
| 3,605,941 | 9/1971 | Edwards . | |
| 3,625,305 | 12/1971 | Mueller . | |
| 3,653,461 | 4/1972 | Huxley . | |
| 3,664,458 | 5/1972 | Sterns . | |
| 3,750,846 | 8/1973 | Huxley . | |
| 3,917,026 | 11/1975 | Hedges . | |
| 4,047,593 | 9/1977 | Dammeyer . | |
| 4,160,492 | 7/1979 | Johnston . | |
| 4,443,900 | 4/1984 | Remeyer . | |
| 4,763,755 | 8/1988 | Murray | 182/2 |
| 4,763,758 | 8/1988 | Moody | 182/2 |

*Primary Examiner*—Reinaldo P. Machado
*Attorney, Agent, or Firm*—Donald S. Holland

[57] ABSTRACT

A simple apparatus is disclosed that reduces the risk of low-back injury to workers in elevated, partially enclosed, aerial baskets. The preferred embodiment basically comprises a circular well within the floor of the basket that is surrounded by a raised footrest platform adapted to receive on foot of the worker. Between the footrest platform and a base of the well is a cylindrical wall that prohibits forward movement under the footrest platform.

In operations, when the worker has to perform manual handling tasks outboard of the basket, one foot is raised out of the well and extended forward onto the footrest platform, while the other foot remains below and behind the raised foot, on the base of the well. The worker has thereby adopted a forward leaning posture instead of a forward bending posture. Consequently, the worker retains the optimal curvature of the spine, while achieving a biomechanical advantage that reduces the work demand on the lower back.

11 Claims, 3 Drawing Sheets

Fig.1.
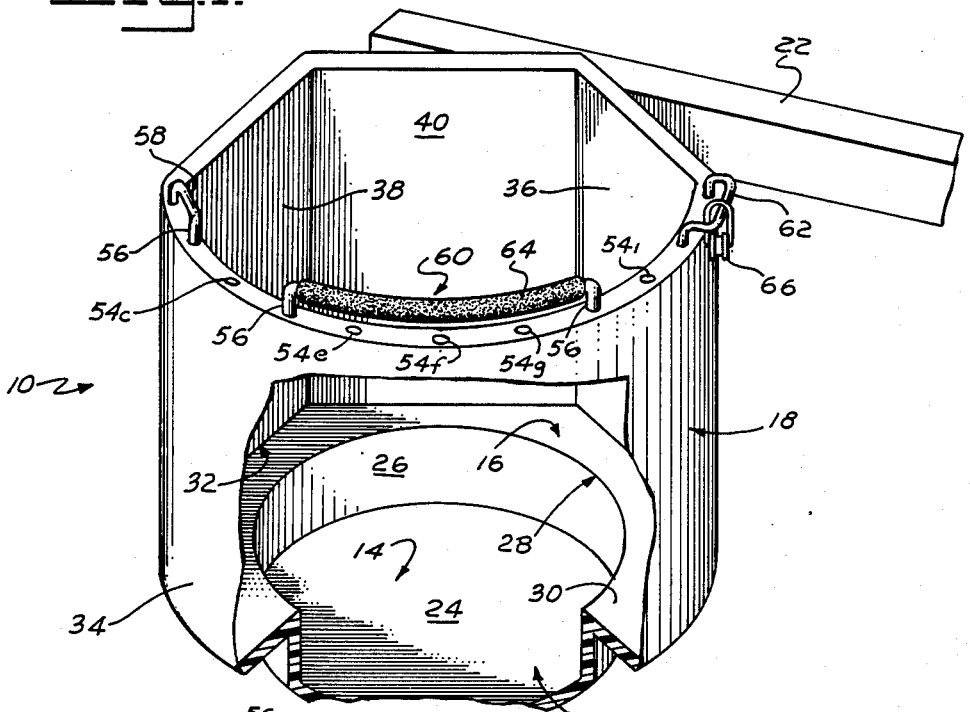
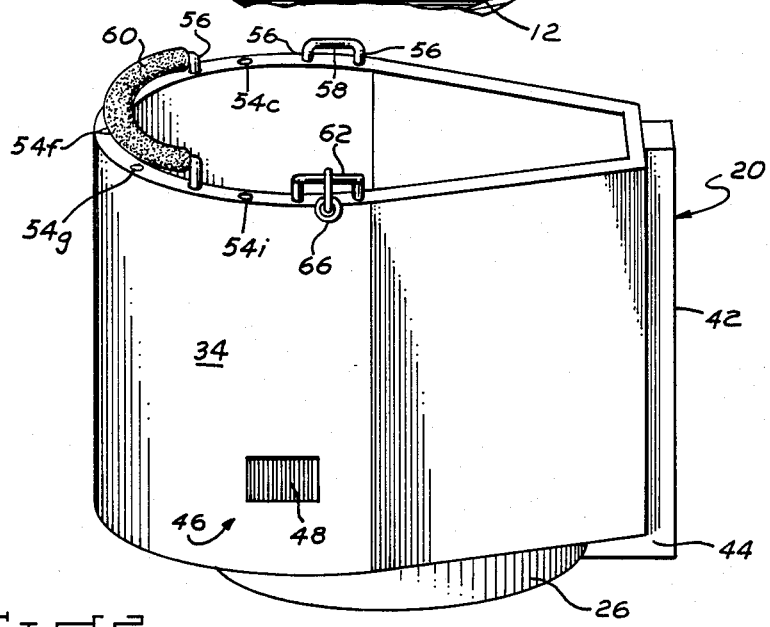
Fig.2.

ERGONOMIC AERIAL BASKET

RELATED APPLICATION

This is a continuation-in-part application of Ser. No. 07/155,537, now abandoned, entitled "ERGONOMIC AERIAL BASKET" and filed on Feb. 12, 1988, by Charles D. DelTatto.

BACKGROUND OF THE INVENTION

The present invention relates to work platforms that are attached to lifts on vehicles. They are known as aerial baskets.

Aerial baskets are most commonly used by utility technicians for installation and servicing of electric power and telephone lines. Frequently, tree maintenance and similar jobs require the use of aerial baskets as well. Typically, a basket is mounted on a folding or telescoping lift attachment connected to the back of a medium sized truck. Most baskets are an open box in which a worker stands. The stand-up area is usually square in cross section, about forty inches deep, with each side being twenty-four inches long.

Current basket designs reflect a great concern for worker safety relating to electrocution and accidental fall hazards. Specific safety design standards have even been developed by the American National Standards Institute, Inc. [See, ANSI: *American National Standard for Vehicle-Mounted Elevating and Rotating Work Platforms* (1969).]

Although these developments have decreased the incidence of catastropic loss, professionals in the field have nonetheless reported significant increases in disabling low-back disorders among those workers regularly using aerial baskets. Applicant has determined that this is primarily because the structural limitations of current aerial baskets oblige the worker to stand in a restrictive work space. To perform manual handling tasks outboard of the standard basket, the worker must bend forward, stressing his spine (see FIG. 6). This posture helps cause the reported back injuries, for four main reasons.

First, the restricted position of one's legs within the basket eliminates any opportunity to achieve a potential biomechanical advantage obtainable through normal movement of the legs. Additionally, because the worker has to bend at the waist, instead of leaning forward, the lower spine is straightened out and loses its normal strengthening curvature. Also, the straightened spine causes the posterior muscles of the lower spine to remain stretched, which lessens their ability to produce force. Finally, the straightened spine simultaneously causes stretching and weakening of the ligaments surrounding the lower spine.

All of these deleterious effects result from the failure of prior aerial basket designs to incorporate modern ergonomic principles.

Accordingly, it is the primary object of the present invention to provide an improved aerial basket that is ergonomically structured to avoid the lower-back problems caused by the prior art.

It is a more specific object to provide an aerial basket which allows workers to retain the proper curvature of their spines while performing manual handling tasks outboard of the basket.

It is another specific object to provide an improved aerial basket which allows workers to achieve a biomechanical advantage that decreases stress to their lower backs while performing manual handling tasks outboard of the basket.

It is yet another object to provide an aerial basket which is commensurate with the above objects and allows workers to perform manual handling tasks throughout a circular operational work zone.

The above and other objects and advantages of this invention will become more readily apparent when the following description is read in conjunction with the accompanying drawings.

SUMMARY OF THE INVENTION

A simple apparatus is disclosed that is attached to a vehicle mounted, elevating lift to enable workers to safely perform tasks high above the ground, on utility poles or trees. This device provides workers with sufficient interior volume to allow for normal movement of their legs and includes a structural feature that enhances proper spinal curvature.

In the preferred embodiment, the invention comprises an ergonomic aerial basket which includes a floor having a circular well in its center that is surrounded by a lip or footrest platform. The outer perimeter of the footrest platform resembles a truncated baseball field and has walls of conventional height. The front wall of the basket is semicircular, like the outfield perimeter of a baseball field. Right and left side walls are integral with the ends of the front wall. They extend outwardly, like the foul lines along first and third base. However, instead of meeting in an apex at home plate, these walls are "truncated" or interconnected by a straight back wall. Affixed to the outside of the back wall is a structural pillar for attachment to the elevating lift.

The floor and walls form an integral unit into which a worker climbs to perform elevated tasks. After the basket has ascended to the desired work position, to perform manual handling tasks outboard of the basket, the worker places one foot on the footrest platform and leaves his other foot in the well. This position moves the worker's center of gravity toward the object being worked upon, yet retains the optimal curvature of his spine for performing lifting, pulling or pushing types of work. Because the footrest platform completely surrounds the circular well, the worker is able to receive the ergonomic benefits of the invention while working at any position within the entire circumference of the basket.

By moving the worker's center of gravity closer to the object, less work has to be performed by his lower-back muscles to achieve the specific task. Further, by placing his spine in a correct posture, this enhances its natural strength and prevents stretching and weakening of the muscles and ligaments surrounding the worker's lower back.

BRIEF DESCRIPTION OF THE DRAWINGS

FIG. 1 is a raised front perspective view of an ergonomic aerial basket constructed in accordance with the present invention, wherein the basket is an integral unit including a floor with a well encompassed by a footrest platform that is connected to surrounding walls;

FIG. 2 is a raised side perspective view of the FIG. 1 basket showing a structural pillar affixed to a back wall and a recessed entry step within a side wall;

DETAILED DESCRIPTION OF THE PREFERRED EMBODIMENT

Figure 3:
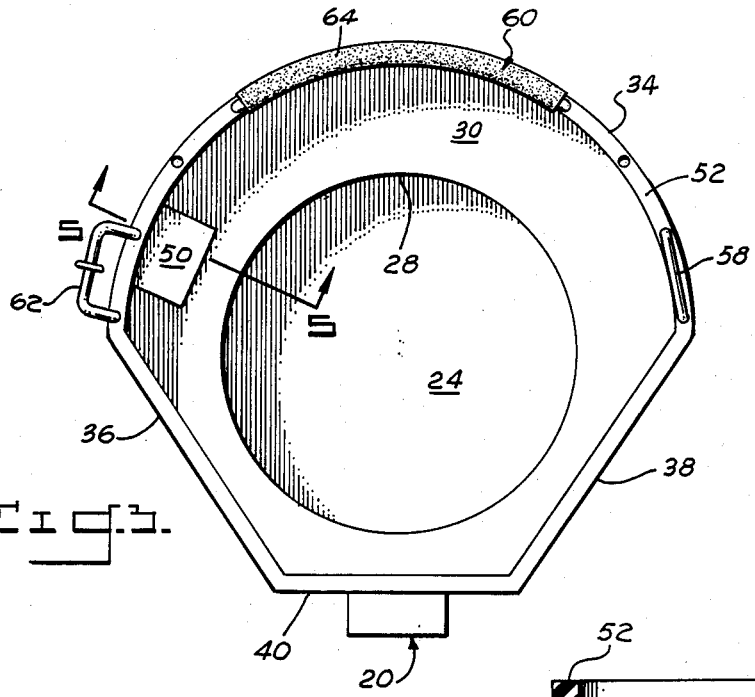
FIG. 3 is a top plan view of the ergonomic aerial basket of FIG. 1.

Referring to the drawings in detail, the preferred embodiment of an ergonomic aerial basket is shown and generally designated by the reference numeral 10. The invention basically comprises a floor 12 within the basket that includes a circular well 14 in which a worker 15 stands; an encompassing raised footrest platform 16 adapted to receive one foot 17 of the worker during performance of manual handling tasks; surrounding walls 18 of conventional height for bracing the worker and protecting against accidental falls from the basket 10; and a structural pillar 20 to which an elevating lift 22 is attached.

The aerial basket 10 is preferably fabricated of a fiberglass reinforced plastic that meets the American National Standard Institute standard requirements for aerial baskets—namely, insulating fabrication material of high dielectric strength, which will not absorb moisture.

The circular well 14 in the basket's floor 12 has an internal diameter that is preferably twenty-four inches. As shown in FIG. 2, the well base 24 is surrounded by a cylindrical wall 26 that rises up to, and is integral with, a circular inner edge or lip 28 of the footrest platform 16. This wall 26 is approximately eight inches high.

A shelf 30 of the footrest platform 16 extends away from the platform's inner edge 28 in a plane parallel to that of base 24. An outer edge 32 is connected to the surrounding walls 18 that ascend perpendicularly to the shelf.

The outer edge 32 and walls 18 form a shape that is roughly equivalent to a truncated baseball field (see FIG. 3). The walls 18 include: a front wall 34 that is approximately semicircular, like the outer perimeter of a baseball outfield; a left side wall 36 and a right side wall 38 that are connected to the front wall 34 and extend in a straight line away from the front wall 34, like the third- and first-base foul lines of a baseball field; and a straight back wall 40 that interconnects the side walls 36, 38.

All the walls 18 extend the same height above the shelf 30 of the footrest 16, preferably thirty inches. The center wall 34 is approximately fifty-eight inches long. The two side walls 36, 38 are both approximately twenty inches long and the back wall 40 is about sixteen inches long.

As best shown in FIG. 3, the front wall 34 is parallel to the cylindrical wall 26 of the well 14. It extends for approximately one hundred and sixty degrees of the circular circumference of the cylindrical wall 26.

The top edge of wall 26 is the same as the footrest's inner edge 28. The distance between that inner edge and the footrest's outer edge 32 varies along the circumference of wall 26, due to the non-circular shape of the basket. For example, the distance between the footrest's inner edge 28 and the portion of outer edge 32 that abuts the front wall 34 is about nine inches; the distance between the inner edge 28 and the portion of outer edge 32 that abuts the side walls 36, 38 varies between approximately nine inches and four inches; and the distance between the inner edge 28 and the portion of outer edge 32 that abuts the rear wall 40 varies between approximately six inches and four inches.

Figure 4:
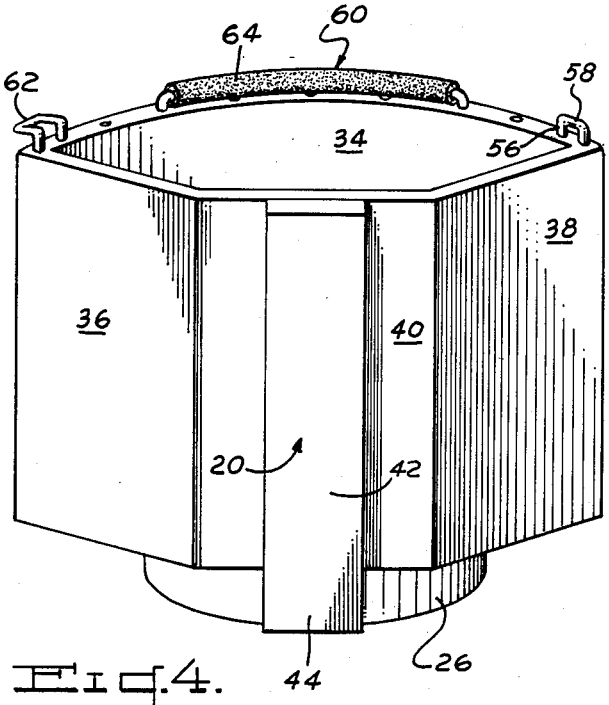
FIG. 4 is a raised rear perspective of the FIG. 3 basket showing the relationship between the structural pillar, back wall and well.
Figure 5:
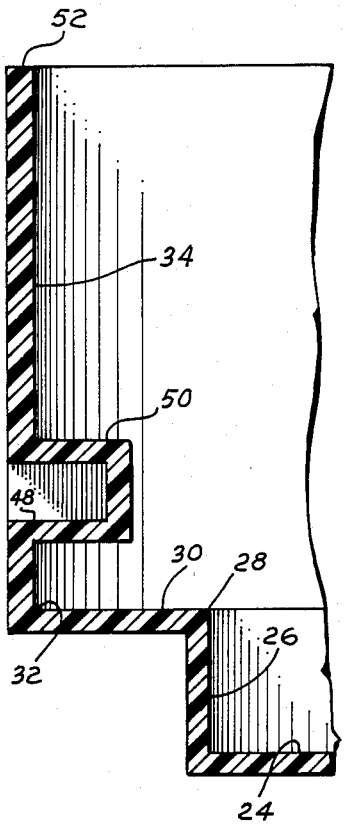
FIG. 5 is a cross sectional view taken along line 5—5 of FIG. 3.
Figure 6:
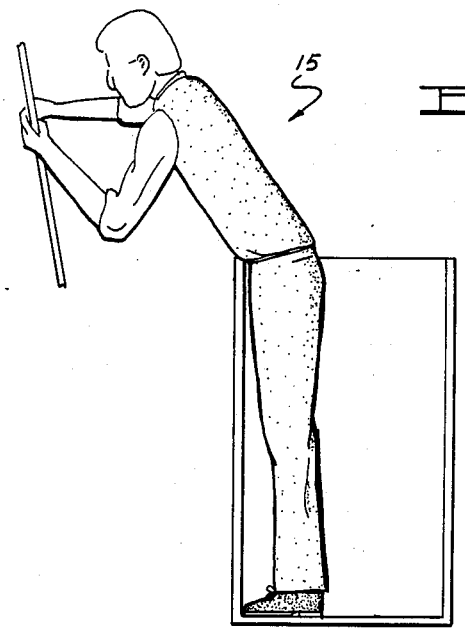
FIG. 6. PRIOR ART
FIG. 6 shows a worker in a prior-art basket bending forward and placing stress on his lower back while performing a task outside of the basket.

As best shown in FIGS. 2 and 4, the structural pillar 20 is "L" shaped and its upper post 42 is affixed to the outside of the back wall 40. The support leg 44 or lower portion of the pillar 20 extends underneath the section of the shelf 30 of the footrest platform 16 that is adjacent to the back wall. The support leg 44 contacts and is integrally affixed to a section of the cylindrical wall 26 that is closest to the back wall 40. The height of the structural pillar 20 is approximately the same as the combined heights of the cylindrical wall 26 and the back wall 40, aproximately thirty-eight inches, and it is about six inches wide. The upper post 42 of the pillar 20 is the same height as the back wall 40, or approximately thirty inches, and the post 42 is preferably three inches deep. The support leg 44 is about eight inches high and extends under the footrest platform, about seven inches, to contact the cylindrical wall 26.

The front wall 34 has a step insert 46 (see FIG. 2) adapted for receiving a worker's foot to assist in climbing over the walls 18 and into or out of the basket 10. The step insert 46 includes a rectangular opening 48 that is approximately four inches high by six inches wide. The opening 48 is one end of a rectangular box 50 that protrudes into the basket (See FIG. 3). This configuration allows a worker to place a foot into the box 50 when climbing into the basket, and also enables him to place a foot on top of the box when climbing out. The opening 48 is approximately four inches high by six inches wide, and the box 50 protrudes about six inches into the basket. The step insert is positioned in the left side wall approximately four inches from the intersection of the front wall 34 with the left side wall 36 and approximately four inches above the outer edge 32 of the footrest platform 16.

As best shown in FIGS. 1 and 3, the upper edge 52 of the front wall includes a plurality of identical, regularly spaced mounting holes 54*a,b,c,d,e,f,g,h,i,j,k* (of which 54*c,e,f,g,i* are shown). They are adapted to receive identical securing posts 56 of a variety of insulated reaching aids 58, 60, 62 (see FIG. 1). Handgrip reaching aid 58 assists a worker in anchoring one arm while pushing, pulling or lifting with the other arm. Chest support reaching aid 60 is an elongated "C" shaped bar that is encased in a soft, insulated material 64 and is adapted to cushion and support a worker's torso while leaning outboard of the basket 10. Pulley brace reaching aid 62 is in the shape of an inverted "U" that is bent downwardly; and it is connected to a pulley 66 to raise or lower items to or from the basket 10. Because the securing posts 56 for each reaching aid 58, 60, 62 are identical and their spacing apart aligns with the spacing of the mounting holes 54*a–k*, the reaching aids can be easily moved to the best location along the upper edge 52 for a specific task.

In operation of the preferred embodiment, a worker 15 places one foot within the step insert 46 to assist in climbing over the walls 18 to enter the ergonomic aerial basket 10. The worker stands with both feet on the base 24 of the circular well 14 at the bottom of the basket.

The basket is then raised to the desired work location and the worker adjusts the reaching aids 58, 60, 62 to the most effective locations along the upper edge 52 of the front wall.

Figure 7:
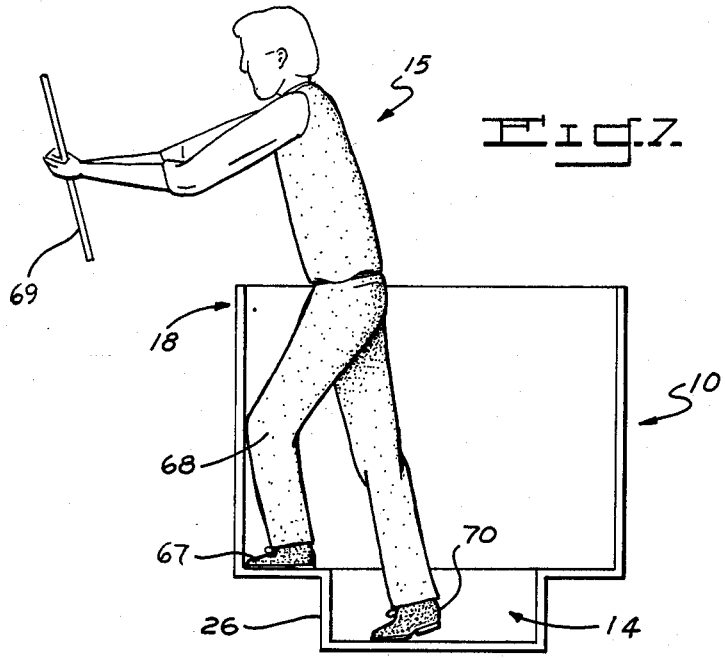
FIG. 7 is a picture of a worker utilizing the present invention, in which his front foot is placed forward and his spine is optimally curved.

As shown in FIG. 7, when the worker then has to perform manual handling tasks, outside of the basket, he places one foot 67 on shelf 30 of the footrest platform 16. Because the space above the platform is unrestricted, except for the step insert 46, his flexed knee 68 can move forward toward the object 69 being worked upon until his knee 68 contacts one of the walls. His lower foot 70 remains on the well base 24 and is prevented from moving toward that work object 69 by the cylindrical wall 26 rising between the base 24 and the footrest platform 16.

The worker has thereby adopted a forward leaning position which effectively moves his center of gravity toward the object being worked upon and retains an optimal curvature of his spine.

As modern ergonomicists would explain, simply placing one foot closer to the object being worked upon achieves a significant biomechanical advantage for the worker's lower back muscles. This is because moving one foot closer to the object, or resistance force, moves his center of gravity, or fulcrum, closer to the object, while his lower back, or applied force, remains approximately stationery. This is roughly equivalent to changing the position of a fulcrum in a primary lever system. When the length of the applied force lever arm is increased and the length of the resistance force lever arm is decreased, the amount of applied force required to produce a specific amount of work, with the present invention, is significantly decreased. Consequently, the worker's lower-back muscles have to produce much less force than with prior baskets to assist in the performance of normal specific tasks.

It should be understood by those skilled in the art that obvious structural modifications can be made without departing from the spirit of the invention. For example, an insert with an internal structure like that of the disclosed ergonomic basket 10 could be used to modify existing prior-art baskets, rather than building entire new baskets. Or, a smaller basket could be made, where the well 14 was non-circular (e.g., rectangular) and surrounded on only three sides by a C-shaped platform, instead of an O-shaped one. Accordingly, reference should be made primarily to the accompanying claims rather than the foregoing specification to determine the scope of the invention.

Having thus described the invention, what is claimed is:

1. An aerial basket for elevating a worker within a partially enclosed platform, comprising:

a. a floor of the basket;

b. a plurality of interconnected walls affixed to the floor that rise perpendicularly up from the floor;

c. a circular well in the floor in which the worker may stand;

d. a cylindrical wall connected to an outer edge of the well that rises perpendicularly up from the well; and e. a footrest platform that is O-shaped and connected at its inner edge to an upper edge of the cylindrical wall and at its outer edge to the bottom edges of the interconnected walls, wherein the footrest platform is elevated above and surrounds the circular well so that the platform is adapted to receive a raised, extended foot of the worker.

2. The basket of claim 1 wherein the interconnected walls have a plurality of identical, evenly spaced mounting holes along the top edges of the walls.

3. The basket of claim 2 wherein the holes mount a chest support reaching aid that comprises an elongated support member having padded insulation material encircling the support member and an inverted L-shaped securing post affixed to each end of the support member, wherein said posts are adapted to removably mount within two of the mounting holes so that the support member extends between the securing posts above and parallel to the top edge of one of the walls a sufficient distance to provide a support for the chest of the worker while the worker is reaching outboard of the aerial basket.

4. An aerial basket for elevating a worker within a partially enclosed platform, comprising:

a. a floor of the basket;

b. a plurality of interconnected walls affixed to the floor that rise perpendicularly up from the floor and in cross section roughly form the shape of a truncated baseball field, including:

i. a front wall that is semicircular, like the outer perimeter of a baseball outfield;

ii. a left side wall having front and rear ends, wherein its front end is connected to a left edge of the front wall, like the third-base foul line of a baseball field;

iii. a right side wall having front and rear ends, wherein its front end is connected to a right edge of the front wall, like the first-base foul line of a baseball field;

iv. a back wall that is connected to the rear ends of the left and right side walls, like a line running between third and first base in a truncated baseball field;

c. a circular well in the floor in which the worker may stand.

d. a cylindrical wall connected to an outer edge of the well that rises perpendicularly up from the well; and e. a footrest platform that is O-shaped and connected at its inner edge to an upper edge of the cylindrical wall and at its outer edge to the bottom edges of the interconnected walls, wherein the footrest platform is elevated above and surrounds the circular well so that the platform is adapted to receive a raised, extended foot of the worker.

5. The basket of claim 4 wherein the front wall has a plurality of identical, evenly spaced mounting holes along its top edge.

6. The basket of claim 5 wherein the mounting holes mount a chest support reaching aid that comprises an elongated support member having padded insulation material encircling the support member and an inverted L-shaped securing post affixed to each end of the support member wherein said posts are adapted to removably mount within two of the mounting holes so that the support member extends between the securing posts above and parallel to the top edge of the front wall a sufficient distance to provide a support for the chest of the worker while the worker is reaching outboard of the aerial basket.

7. The basket of claim 6 wherein the mounting holes mount a hand grip reaching aid that comprises a hand grip support member of non-conductive material and an inverted L-shaped securing post affixed to each end of the support member wherein said posts are adapted to removably mount within two of the mounting holes so that the hand grip support member extends between the posts and above the top edge of the front wall a sufficient distance to provide a hand grip for the worker while pulling, pushing or lifting with the other hand.

8. The basket of claim 7 wherein the mounting holes mount a pulley brace reaching aid that comprises an elongate, n-shaped pulley support member of non-conductive material and an inverted L-shaped securing post affixed to each end of the support member such that the securing posts extend outboard of the aerial basket and are adapted to removably mount within two of the mounting holes so that the pulley support member extends betwen the posts above and outboard of the top edge of the front wall to provide a brace for securing a pulley.

9. In an aerial basket of the type atttached to an elevated lift, said basket having a floor and surrounding walls extending sufficiently upwardly therefrom to brace a worker inside and protect him against accidental fall from the basket, the improvement comprising a well in the floor in which the worker can stand, and an elevated lip on the top of the well that provides an ergonomic footrest for the worker during his performance of manual tasks outside the basket.

10. An aerial basket for elevating a worker within a partially enclosed platform comprising:

a. a floor of the basket;

b. a plurality of interconnected walls affixed to the floor that rise perpendicularly up from the floor and in cross section roughly form the shape of a truncated baseball field, including:

i. a front wall that is semi-circular, like the outer perimeter of a baseball outfield and includes a plurality of identical, evenly spaced mounting holes;

ii. a left side wall having front and rear ends, wherein the front end is connected to a left edge of the front wall, like the third-base foul line of a baseball field;

iii. a right side wall having front and rear ends, wherein its front end is connected to a right edge of the front wall, like the first-base foul line of a baseball field;

iv. a back wall that is connected to the rear ends of the left and right side walls, like a line running between third and first base in a truncated baseball field;

c. a circular well in the floor in which the worker may stand;

d. a cylindrical wall connected to an outer edge of the well that rises perpendicularly up from the well;

e. a footrest platform that is O-shaped and connected at its inner edge to an upper edge of the cylindrical wall and at its outer edge to the bottom edges of the interconnected walls, wherein the footrest platform is elevated above and surrounds the circular well so that the platform is adapted to receive a raised, extended foot of the worker;

f. a chest support reaching aid that includes an elongated support member having padded insulation material encircling the support member and an inverted L-shaped securing post affixed to each end of the support member, wherein said posts are adapted to removably mount within two of the mounting holes so that the support member extends between the securing posts above and parallel to the top edge of the front wall a sufficient distance to provide a support for the chest of the worker while the worker is reaching outboard of the aerial basket;

g. a hand grip reaching aid that includes a hand grip support member of non-conductive material and an inverted L-shaped securing post affixed to each end of the support member wherein said posts are adapted to removably mount within two of the mounting holes so that the hand grip support member extends between the posts and above the top edge of the front wall a sufficient distance to provide a hand grip for the worker while pulling, pushing or lifting with the other hand;

h. a pulley brace reaching aid that includes an elongated, n-shaped pulley support member of non-conductive material and an inverted L-shaped securing post affixed to each end of the support member such that the securing posts extend outboard of the aerial basket and are adapted to removably mount within two of the mounting holes so that the pulley support member extends between the posts above and outboard of the top edge of the front wall to provide a brace for securing a pulley;

i. a step insert in one of the sidewalls that includes a rectangular box having an opening end projecting through the wall, wherein the box extends into the basket to permit the worker to insert a foot into the box from outside the basket to assist in stepping up, over the wall and into the aerial basket and to allow the worker to place a foot on top of the box to assist in stepping up, over the wall, to exit the aerial basket; and j. an L-shaped structural pillar that is connected to the outboard side of the rear wall and extends under the footrest platform to affix to the outboard side of the cylindrical wall, wherein the pillar is adapted to attach to an elevating boom.

11. An aerial basket for elevating a worker within a partially enclosed platform, comprising:

a. a floor of the basket;

b. a plurality of interconnected walls affixed to the floor that rise perpendicularly up from the floor;

c. a well in the floor in which the worker may stand;

d. a cylindrical wall connected to an outer edge of the well that rises perpendicularly up from the well; and e. a footrest platform that is connected at its inner edge to an upper edge of the cylindrical wall and at its outer edge to bottom edges of the interconnected walls, wherein the footrest platform is elevated above and is peripheral to a majority of the well so that the platform is adapted to receive a raised, extended foot of the worker.

* * * * *